United States Patent [19]

Derry

[11] 3,971,231

[45] July 27, 1976

[54] REFRIGERATOR WITH DRY ICE COOLANT

[76] Inventor: Juanita Derry, 2009 W. Washington St., Ext., New Castle, Pa. 16101

[22] Filed: Mar. 27, 1974

[21] Appl. No.: 455,515

[52] U.S. Cl. ..... 62/388; 62/446; 62/449; 62/457; 62/459

[51] Int. Cl.[2] ..... F25D 3/12

[58] Field of Search ..... 62/384, 388, 420, 421, 62/422, 423, 457, 443–447, 382, 385, 383, 440, 448, 449, 459

[56] References Cited

UNITED STATES PATENTS

| | | | |
|---|---|---|---|
| 643,013 | 2/1900 | Stuart | 62/420 X |
| 1,654,828 | 1/1928 | Nelson | 62/388 |
| 2,305,740 | 12/1942 | Shively | 62/385 |
| 2,457,043 | 12/1948 | Histand | 62/457 |
| 2,496,296 | 2/1950 | Lobl | 62/457 |
| 2,786,339 | 3/1957 | Roberts | 62/388 |
| 3,069,869 | 12/1962 | Mueller | 62/457 X |
| 3,678,703 | 7/1972 | Cornish et al. | 62/457 X |

*Primary Examiner*—William F. O'Dea
*Assistant Examiner*—Ronald C. Capossela
*Attorney, Agent, or Firm*—Harpman and Harpman

[57] ABSTRACT

A refrigerator incorporates an insulated cabinet having an access opening and a door normally closing said opening with at least one dry ice carrier removably disposed in said cabinet in alignment with said access opening. Said dry ice carrier takes the form of a container having a solid side and a perforated side and of a size and shape enabling the dry ice carrier to be positioned at one side of said insulated cabinet or transversely thereof as desired.

5 Claims, 6 Drawing Figures

REFRIGERATOR WITH DRY ICE COOLANT

BACKGROUND OF THE INVENTION

1. Field of the Invention

This invention relates to refrigerated cabinets and more particularly to refrigerators in which dry ice can be used as a coolant. (Solid carbon dioxide)

2. Description of the Prior Art

Prior structures of this type include ice cream cabinets with vertically sliding trays such as seen in U.S. Pat. Nos. 1,576,955 and 1,696,349 wherein the sliding trays are partially perforated and are used for holding confections or the like in the refrigerated space of the ice cream cabinet. A lunch box having a refrigerant carrier positioned in one end thereof is shown in U.S. Pat. No. 2,457,043, the carrier is not perforated and imparts a uniform cooling to the lunch box regardless of its arrangement or positioning therein. U.S. Pat. No. 2,543,524 shows a food carrier in which compartments are provided for either heated or cooled materials and U.S. Pat. No. 1,408,260 illustrates a refrigerated cabinet in which a refrigerant containing device forms a false back wall and bottom wall therein in which crushed ice for example can be positioned.

This invention provides a simple and efficient dry ice carrier constructed so that repositioning the same in the cabinet permits a choice of either a refrigerated or freezing compartment or both to be realized.

SUMMARY OF THE INVENTION

A refrigerator for a dry ice coolant comprises an insulated cabinet with an access opening and a door closure therefore and a dry ice carrier removably positioned therein so as to form one or two sides of the cabinet or a transversely positioned horizontally disposed partition with the one side of the dry ice carrier perforated and the other side solid so that more intense cooling is realized in the insulated cabinet on the perforated side of the carrier.

DESCRIPTION OF THE PREFERRED EMBODIMENT

Figure 1:
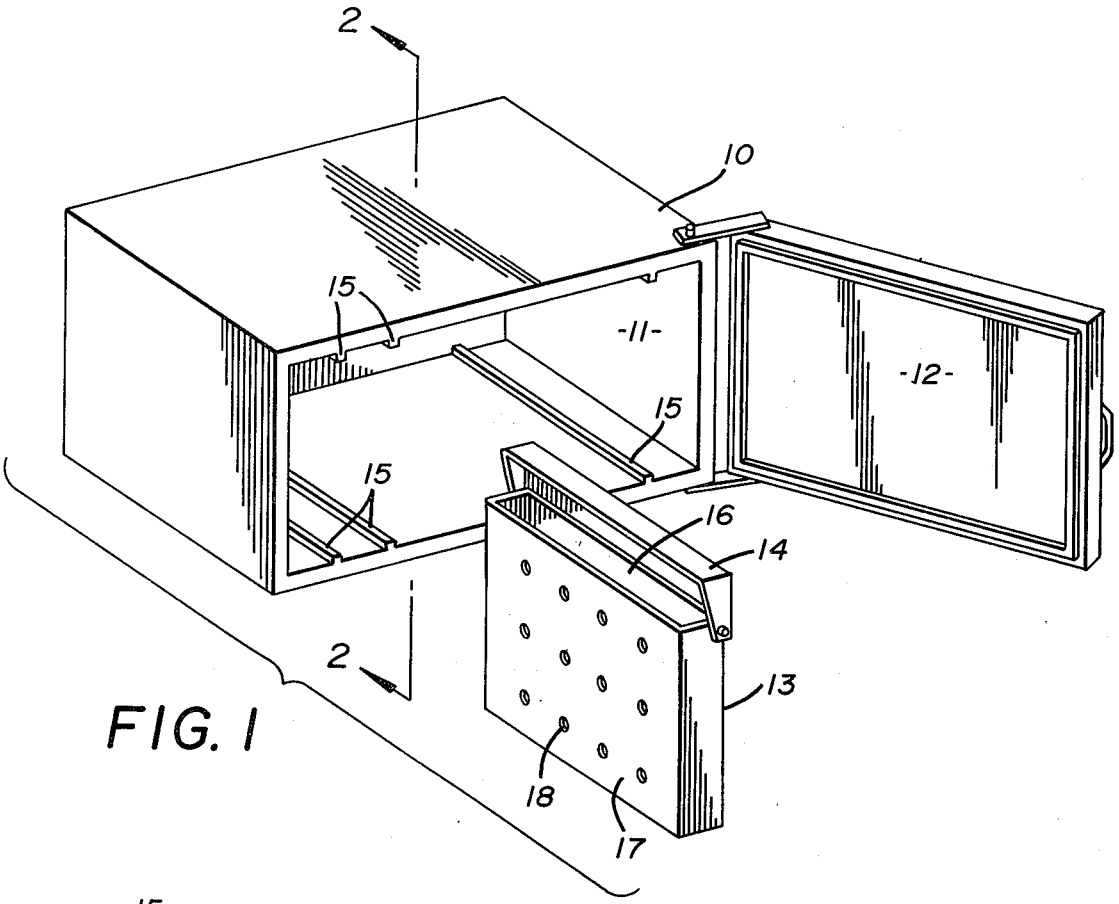
FIG. 1 is a perspective elevation of a refrigerator with a dry ice coolant with the closure in open position and a dry ice carrier removed therefrom.

In the form of the invention chosen for illustration and description herein the refrigerator with dry ice coolant in its simplest form consists of an insulated cabinet 10 having an access opening 11 and a hinged closure 12 therefore. A dry ice carrier comprising a container 13 having a lid 14 is adapted to be positioned in one or both sides of the insulated cabinet 10 and guide rails 15 are provided on the upper and lower surfaces of the insulated cabinet 10 on the interior thereof so that the container or containers 13 will be appropriately positioned therein.

In FIG. 1 of the drawings, the container 13 is shown exteriorly of the insulated cabinet 10 and it will be observed that it has a solid side 16 and a perforated side 17, the perforations therein being indicated by the numeral 18.

Figure 2:
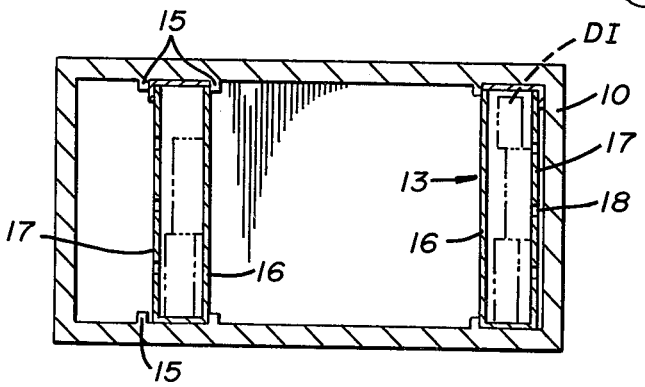
FIG. 2 is a vertical section on line 2—2 of FIG. 1 showing dry ice carriers in position therein.

By referring now to FIG. 2 of the drawings it will be seen that cross sectional representations of two of the containers 13 are shown in the cross sectional elevation of the insulated cabinet 10 and that the solid sides 16 are positioned in facing relation toward one another so that the space therebetween will be chilled and act as a suitable food and drink refrigerator.

Figure 6:
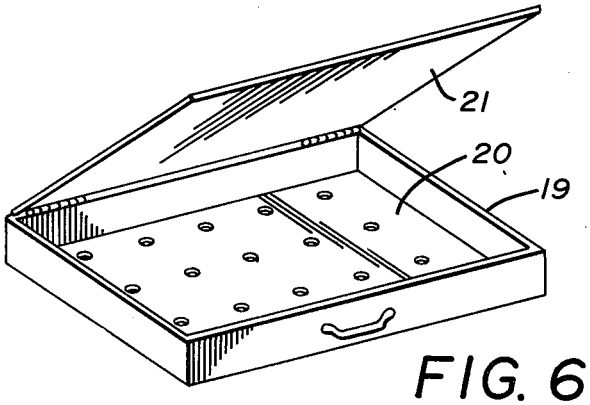
FIG. 6 is a perspective view of the dry ice carrier seen in FIGS. 3, 4 and 5.

It will be further observed that one of the containers 13 has been positioned in spaced relation to one of the side walls of the insulated cabinet 10 so that the perforated side 17 thereof communicates with a relatively small space in the side of the insulated cabinet 10 which then becomes a freezer due to the improved circulation of cold air and carbon dioxide from blocks of dry ice positioned therein as shown in broken lines in FIG. 2 of the drawings. While the containers 13 are shown in FIGS. 1 and 2 with lids 14 on their upper narrow ends they may also be formed with hinged lids on one of their sides as seen in FIG. 6 of the drawings wherein the dry ice container is generally indicated at 19, the perforated wall thereof at 20 and the solid wall thereof at 21.

Figure 3:
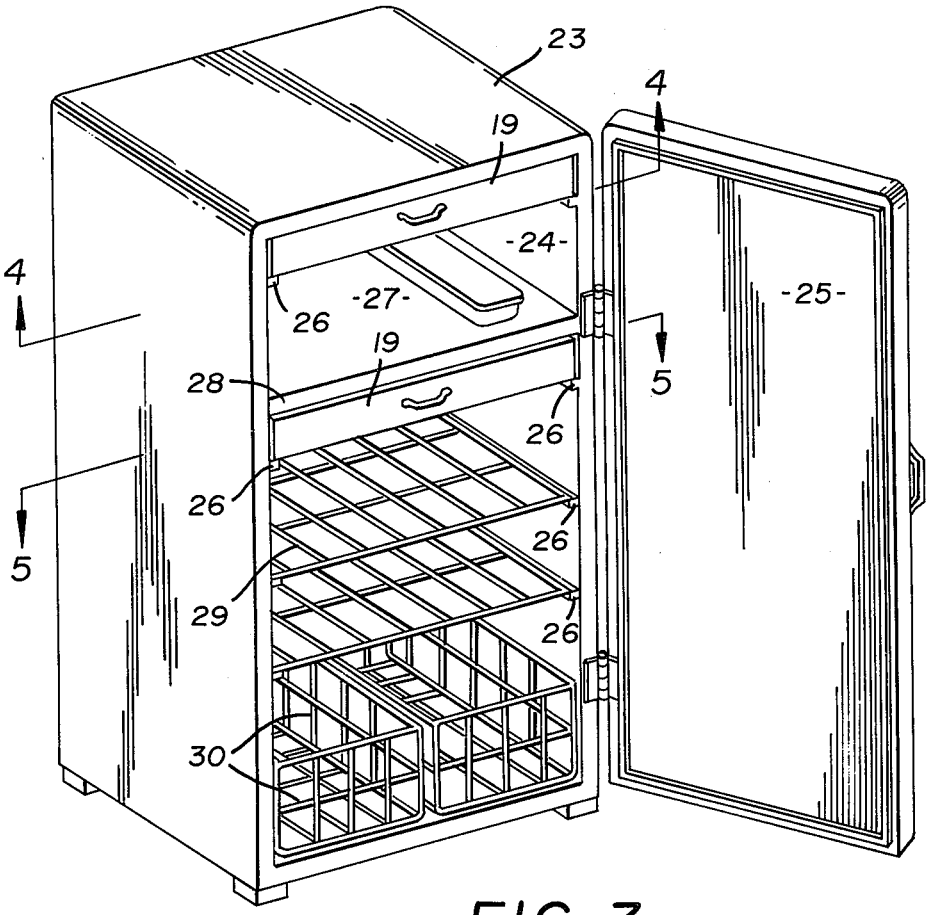
FIG. 3 is a perspective elevation of a modified form of refrigerator with dry ice coolant showing the dry ice carriers in horizontal position and forming a partition therein.
Figure 4:
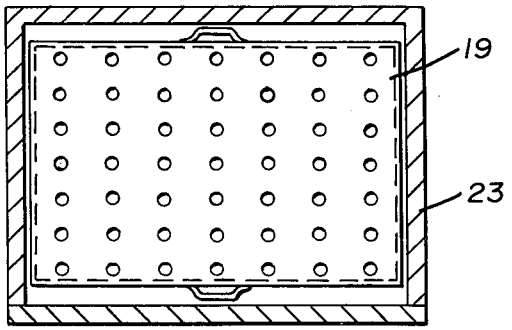
FIG. 4 is a cross sectional elevation on line 4—4 of FIG. 3.
Figure 5:
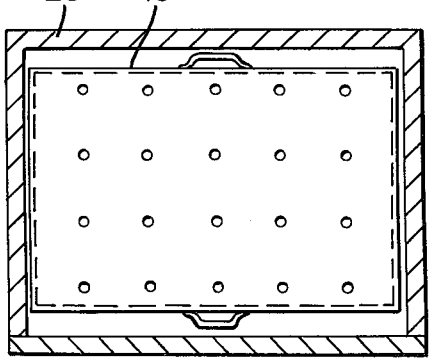
FIG. 5 is a cross sectional elevation on line 5—5 of FIG. 3.

Modifications of the refrigerator with dry ice coolant will occur to those skilled in the art and one such modification can be readily formed by moving the dry ice containers 13 to horizontal position and spacing them vertically as seen in FIG. 3 of the drawings.

By referring to FIG. 3 of the drawings, it will be observed that an insulated cabinet 23 is illustrated with an access opening 24 and a hinged closure 25 therefor. Guide rails 26 on the sides of the inner surfaces of the insulated cabinet 23 permit the positioning of a pair of dry ice containers 19 as seen in FIG. 6 of the drawings.

By referring again to FIG. 3 of the drawings, it will be seen that by placing one of the dry ice containers 19 in spaced relation to the other, a freezer compartment 27 may be formed and it will be observed that the perforated side of the dry ice container 19 communicates directly with the top of the freezer compartment 27. The second dry ice container 19 spaced therebelow may be positioned with its solid or perforated side in communication with the freezer compartment 27 as desired and as illustrated an intermediate shelf 28, which may or may not be perforated, is positioned to support ice cube trays and other materials slightly above the second dry ice container 19. The space beneath the second dry ice container 19 forms the usual cooled chamber of a refrigerator in which wire shelves 29 and baskets 30 or the like may obviously be positioned.

It will occur to those skilled in the art that by reversing the positioning of the dry ice containers 13 as seen in FIGS. 1 and 2 of the drawings or their equivalent dry ice containers 19 as seen in FIGS. 3 – 6 of the drawings, the portions of the insulated cabinets 10 and 23 respectively may be used as freezers or regriferators and the dry ice coolant exposed to the respective chambers controlled by the positioning of the perforated sides of the dry ice containers.

It will thus be seen that a simple and efficient refrigerator with dry ice coolant has been disclosed which can be economically formed, easily maintained by commercially available dry ice at low cost and that the respective portions of the refrigerator can be used as freezers or refrigerators partially or entirely depending upon the desire of the user.

Although but two embodiments of the present invention have been illustrated and described, it will be apparent to those skilled in the art that various changes and modifications may be made therein without departing from the spirit of the invention.

Having thus described my invention what I claim is:

1. A refrigerator consisting of an insulated cabinet having an access opening and a hinged insulated closure therefor and at least one hollow partition forming a receptacle, dry ice positioned in said receptacle, said hollow partition being positioned in said insulated cabinet and being of a size dividing the interior of said insulated cabinet into two separate areas, said hollow partition having a perforated side and an unperforated side and located in said insulated cabinet so that the perforated side communicates with one of said separate areas to form a freezer and the unperforated side communicates with the other of said separate areas to form a refrigerator.

2. The refrigerator set forth in claim 1 and wherein the hollow partition consists of a narrow box with a closure on one of its narrow sides.

3. The refrigerator set forth in claim 1 and wherein the hollow partition consists of a shallow box with an access opening and closure on one of its top and bottom sides.

4. The refrigerator set forth in claim 1 and wherein guide rails are formed on the interior of the insulated cabinet from the access opening to the opposite side thereof and in spaced relation to the sides of the insulated cabinet so as to receive the hollow partition in vertical standing position therebetween and in movable relation to the access opening.

5. The refrigerator set forth in claim 1 and wherein guide rails are formed on the sides of the interior of the insulated cabinet from the access opening to the opposite side thereof and in spaced relation so as to receive the hollow partition in horizontal position therebetween and in movable relation to the access opening.

* * * * *